US006418005B1

(12) United States Patent
Endo et al.

(10) Patent No.: US 6,418,005 B1
(45) Date of Patent: Jul. 9, 2002

(54) POWER CIRCUIT BREAKER

(75) Inventors: Takayoshi Endo; Norio Matsumura; Goro Nakamura, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/498,650

(22) Filed: Feb. 7, 2000

(30) Foreign Application Priority Data

Mar. 3, 1999 (JP) ..... 11-055054

(51) Int. Cl.[7] ..... F23Q 3/00

(52) U.S. Cl. ..... 361/247; 361/104; 337/168; 337/170; 337/186; 337/414

(58) Field of Search ..... 361/247, 248, 361/261, 264, 266, 103, 104; 337/158, 159, 168, 169, 182–184, 186, 208, 228, 401, 414, 170

(56) References Cited

FOREIGN PATENT DOCUMENTS

| | | |
|---|---|---|
| JP | 5-342979 | 12/1993 |
| JP | 7-201269 | 8/1995 |
| JP | 10-55742 | 2/1998 |
| JP | 10-241522 | 9/1998 |
| JP | 10-241523 | 9/1998 |
| JP | 10-241524 | 9/1998 |

*Primary Examiner*—Ronald W. Leja
(74) *Attorney, Agent, or Firm*—Armstrong, Westerman & Hattori, LLP.

(57) ABSTRACT

The power circuit breaker has an igniter unit disposed in a cylindrical wall formed in a main housing. A holder is disposed in the cylindrical wall so as to oppose to the igniter unit. The holder has a boss engaged with the cylindrical wall, and a fuse element is held by the holder. Each end of the fuse element is electrically connected to one of a pair of interconnection terminals disposed in the main housing. The holder is locked by a locking lance formed in the main housing when each end of the fuse element has engaged with one of the interconnection terminals. The holder rests on the locking lance when the fuse element has been released from the interconnection terminals after activation of the igniter unit. The fuse element is engaged with and stopped by an insertion hole of the holder. The interconnection terminals each are a receptacle type terminal having two resilient contact strip portions one of which is connected to one end of the fuse element and the other of which is connected to an opposing terminal of a power circuit.

10 Claims, 5 Drawing Sheets

POWER CIRCUIT BREAKER

BACKGROUND OF THE INVENTION

1. Field of the Invention

The present invention relates to a power circuit breaker to cut off instantaneously a power circuit with a gas pressure generated by an igniter unit to release a fuse element from a pair of interconnection terminals.

2. Related Art

FIG. 3 shows a conventional fuse 61 for cutting off a large power circuit. The fuse 61 has a synthetic resin main housing 62, a conductive metal fuse element 63 received in the main housing, and a synthetic resin cover 64 for covering an upper opening of the main housing 62.

The fuse element 63 has a generally U-shaped base plate 65, two terminals 66 each unitarily formed with the base plate 65 at one end thereof, a tin piece 67 disposed on the base plate 65 for thermal accumulation. Each terminal 66 is opposed to a resilient contact strip 68 formed separately from the fuse element 63. The terminal 66 and resilient contact strip 68 can contact a pin terminal of a fuse box (not shown) or the like. The pin terminal is inserted from a lower opening 69 of the main housing 62.

The base plate 65 is formed with a locking piece 70 extending diagonally outward. The locking piece 70 abuts against an inner shoulder of the main housing 62 to prevent the fuse element 63 from being released from the main housing 62. The base plate 65 is fused by an overcurrent to cut off an associated power circuit.

FIG. 4 is a graph showing a time required for fusing of the fuse 61. The time is a function of applied current. This fuse characteristic is obtained by a measurement devise shown in FIG. 5.

In FIG. 5, denoted 61 is a fuse, 71 a busbar connected to the fuse 61, and 72 an electrical wire connected to the busbar 71 for power supply. Two busbars 71 are fixed on a base 73 made of an insulation material. Each busbar 71 has an upward extending male terminal 74 which can be connected to the terminal 66 (FIG. 3) of the fuse 61.

As illustrated in FIG. 4, the fusing time T of the fuse 61 (FIG. 5) decreases like a quadratic curve as current I increases. Particularly, where the applied current I is comparatively small, the fusing time T increases significantly, which is shown in a zone surrounded by a phantom line A. The vertical scale for the fusing time T is logarithmic.

The conventional fuse 61, as shown in FIG. 4, requires a significantly long fusing time when the overcurrent is within a smaller range. Thus, it is difficult to cut off instantaneously an associated circuit against a smaller overcurrent. This happens also in case of an intermittent short circuit or a rare short circuit current. In addition, even in an abnormal vehicle state like a collision accident, a power circuit is not cut off when no sufficient excessive current is supplied. The conventional fuse has the disadvantages.

To solve these problems, there is proposed a power circuit breaker 76 shown in FIGS. 6 and 7.

Referring to FIG. 6, the power circuit breaker 76 has a pair of terminals 77, 78, two multi-contact-point elastic plates 80 (FIG. 7) each connected to one of the terminals 77, 78, an electrically conductive shaft 79 slidably contacting with the plates 80, and an igniter unit 81 disposed in one side of the shaft 79.

The shaft 79 is joined to a drive shaft 82 at the other end thereof. The drive shaft 82 is mounted with a torsion spring 83. The igniter unit 81 has a gas-blasting agent and a heater therein. The heater is connected to a pair of lead wires 84. The shaft 79 and the drive shaft 82 are slidably received in a housing 85 of the power circuit breaker 76.

In FIG. 6, the terminals 77, 78 each are connected to the shaft 79 by way of one of the plates 80. An overcurrent flown between the terminals 77, 78 is detected by a sensor. Successively, a current is applied to the lead wires 84, so that the heater heats up the gas blasting agent. The blasting gas pressure moves the shaft 79 in its disconnecting direction, This cuts off electrical connection between the terminals 77, 78. The torsion spring 83 urges the stopper 86 outward so that the stopper 86 abuts against the housing 85, preventing a return movement of the shaft 79.

However, the power circuit breaker 76 has disadvantages described in the following. That is, the power circuit breaker 76 has the expensive multi-contact-point elastic plates 80 connected to the terminals 77, 78 for allowing a decreased friction force. Furthermore, the power circuit breaker 76 requires parts increased in number and in cost and is complicated in configuration, because the torsion spring 83 and the stopper 86 are applied for stopping the shaft 79. In addition, the multi-contact-point elastic plates 80 make the terminals 77, 78 and the shaft 79 larger for reducing an electrical resistance between the plates 80 and the shaft 79, which tends to enlarge related parts of the power circuit breaker 76, resulted in an enlarged breaker in overall size.

Japanese Patent Application H. 10-241524 discloses a power circuit breaker (not shown) in which a gas bursting force breaks a connection substrate to cut off a power circuit. Because of this configuration, the power circuit breaker is not reusable and is not commonly applied to various uses. Moreover, the power circuit breaker has another disadvantage that its main housing including an igniter unit requires an additional fitting work to secure it by bolting.

SUMMARY OF THE INVENTION

In view of the disadvantages of the aforementioned fuse and breakers, an object of the invention is to provide a power circuit breaker which can positively cut off a power circuit even at a smaller overcurrent. The breaker also allows a reliable cut-off of the power circuit when a sensor detects an abnormal state like an unintentional heat generation state or on a vehicle collision accident. In addition, the breaker has a simplified configuration consisting of parts reduced in number. The breaker is not expensive in cost, compact, easy in assembling, reusable, and suitable for a general-purpose.

For achieving the object, a power circuit breaker according to a first aspect of the present invention includes a main housing, an igniter unit disposed in a cylindrical wall formed in the main housing, a holder disposed in the cylindrical wall so as to oppose to the igniter unit, a boss of the holder engaging with the cylindrical wall, a fuse element held by the holder, and a pair of interconnection terminals disposed in the main housing. Each end of the fuse element is electrically connected to one of the interconnection terminals.

In a second additional aspect of the present invention, the holder is locked by a locking lance formed in the main housing when each end of the fuse element has engaged with one of the interconnection terminals.

In a third additional aspect of the present invention, an activating pressure force generated by the igniter unit is larger than the sum of the stopping force of the locking lance and the friction force of the interconnection terminals to the fuse element.

In a fourth additional aspect of the present invention, the holder rests on the locking lance when the fuse element has been released from the interconnection terminals after activation of the igniter unit.

In a fifth additional aspect of the present invention, the fuse element is engaged with and stopped by an insertion hole of the holder.

In a sixth additional aspect of the present invention, the igniter unit is pressed into to be mounted in the cylindrical wall.

In a seventh additional aspect of the present invention, the interconnection terminals each are locked in the main housing with a locking piece.

In an eighth additional aspect of the present invention, the interconnection terminals each are a receptacle type terminal having two resilient contact strip portions one of which is connected to one end of the fuse element and the other of which is connected to an opposing terminal of a power circuit.

In the first aspect of the invention, the cylindrical wall can guide the boss of the holder like a cylinder-piston movement, so that the gas blasting pressure reliably forces out the holder. Thus, the breaker can rapidly cut off the power circuit even on a smaller overcurrent or on an abnormal state of the vehicle where there is no overcurrent such as collision or an unintentional heat generation in the vehicle. The igniter unit is reduced in size because of the above-mentioned construction of the holder and cylindrical wall, which makes the power circuit breaker compact. The fuse element and interconnection terminals, which are simple and not expensive, can disengage from each other to reliably cut off the power circuit because the holder retaining the fuse element is moved by the blasting pressure of the igniter unit. The power circuit breaker has more functions than the conventional large current fuse but causes no significant size increase as compared with the conventional fuse. In addition, the fuse element which is fused by a current larger than a predetermined value can cut off the power circuit on an overcurrent without ignition of the igniter unit, allowing a selective use thereof including reuse according to an application of the breaker.

In the second additional aspect of the invention, the holder is reliably retained on the housing by the locking lance while the interconnection terminals engage with the fuse element. In addition, the holder can be easily mounted on and removed from the housing.

In the third additional aspect of the invention, on ignition of the igniter unit, the locking lance positively releases the holder so that the fuse element disengages from the interconnection terminals to cut off the associated power circuit.

In the fourth additional aspect of the invention, the holder is resting on the lance when the lance has been released the holder, preventing the fuse element from unintentionally contacting the interconnection terminals to keep a cut-off state of the power circuit. The lance used for the locking and retaining of the holder is advantageous for reduction in part number and in manufacturing cost.

In the fifth additional aspect of the invention, the fuse element is S inserted into the through holes of the holder to be locked therein, allowing an easy engagement with the holder. The fuse element can be readily disengaged from the holder. The holder can be commonly used for various applications with changing the fuse element according to the associated circuit. That is, the power circuit breaker is suitable for general purpose applications, which enables standardized and reusable parts, resulted in reduction in cost of the breaker.

In the sixth additional aspect of the invention, the igniter unit is easily pushed in the cylindrical wall to be set therein. The igniter unit can be dismounted from the cylindrical wall for replacement with ease.

In the seventh additional aspect of the invention, the locking piece can readily lock the interconnection terminal in the housing. Moreover, the interconnection terminal can be removed from the housing for maintenance by releasing engagement with the locking piece.

In the eighth additional aspect of the invention, the interconnection terminals, which can electrically connect the fuse element to the lead terminals, each have the two resilient contact strip portions. The construction of the interconnection terminals is useful for reduction in part number and in manufacturing cost.

DETAILED DESCRIPTION OF THE PREFERRED EMBODIMENT

Figure 1:
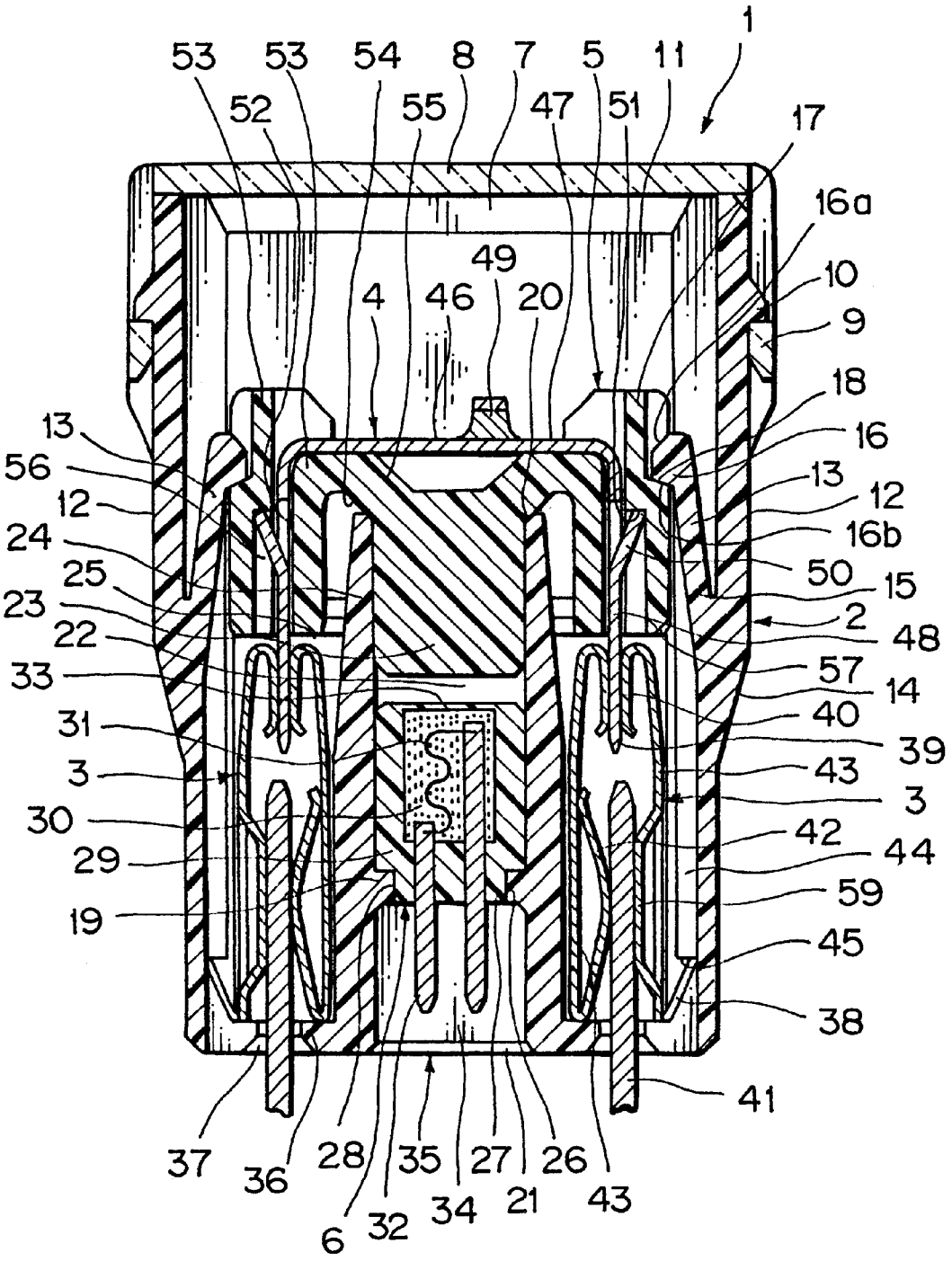
FIG. 1 is a longitudinal sectional view showing an embodiment of a power circuit breaker according to the present invention, the breaker being in a circuit connection state.
Figure 2:
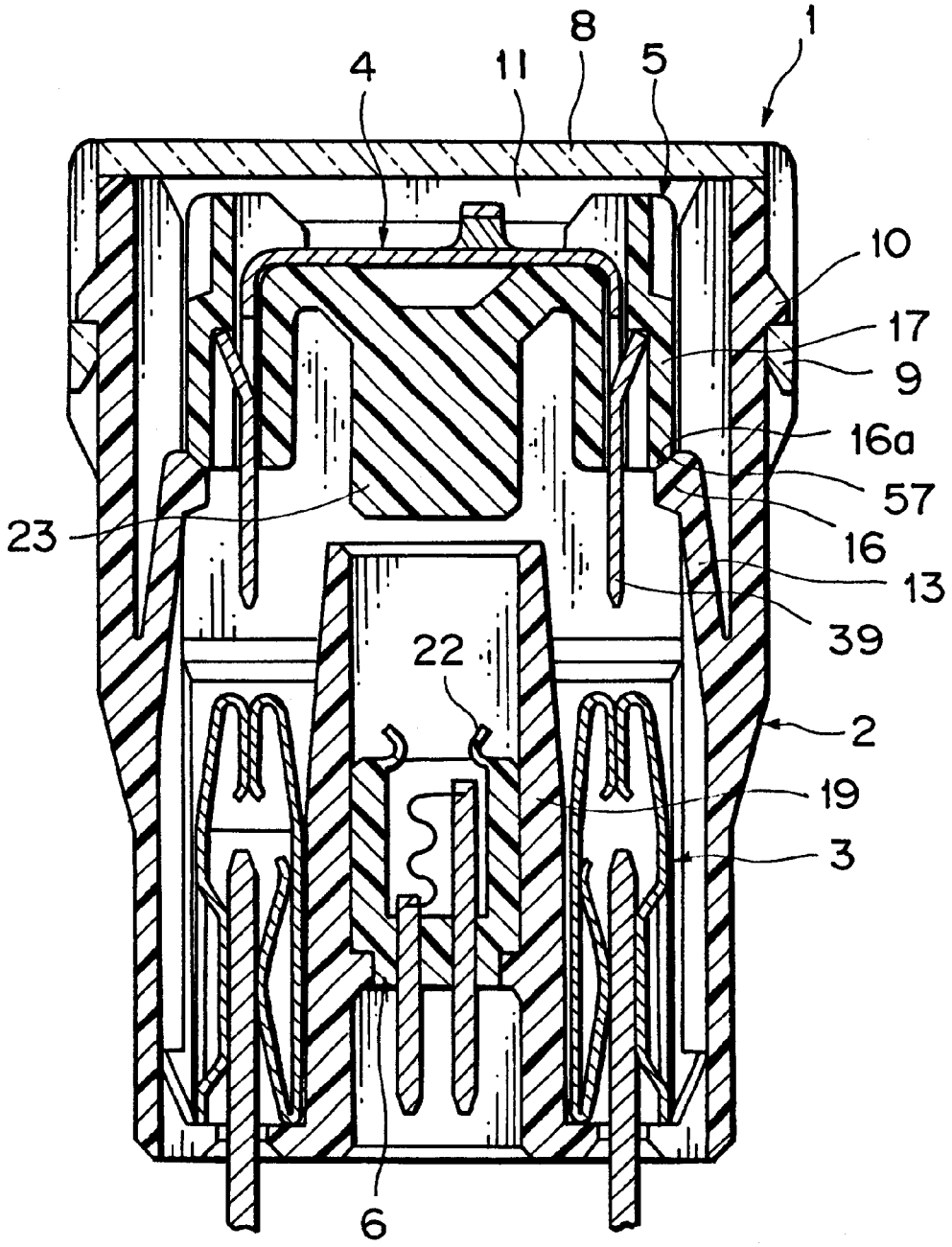
FIG. 2 is a longitudinal sectional view showing the breaker which is in circuit disconnection state.
Figure 5:
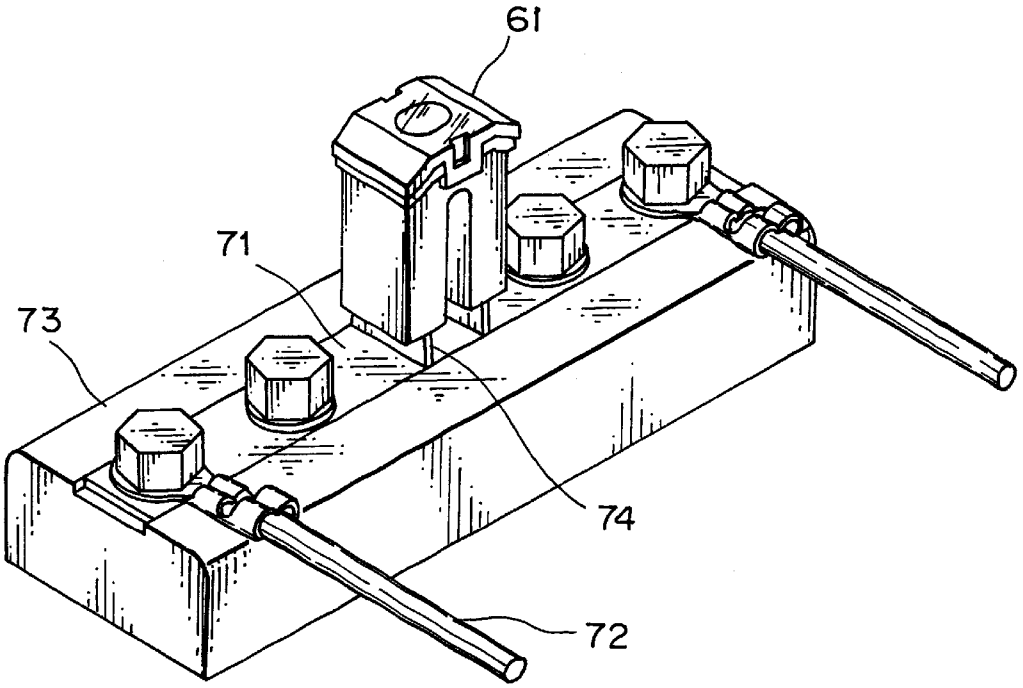
PRIOR ART FIG. 5
FIG. 5 is a perspective view showing a measurement devise for knowing a performance of a fuse.

Referring to the accompanied drawings, an embodiment of the present invention will be discussed in detail hereinafter. FIGS. 1 and 2 show an embodiment of a power circuit breaker according to present invention.

In FIG. 1, a power circuit breaker 1 has an insulating, synthetic resin housing 2, a pair of receptacle-type interconnection terminals 3, a generally inverted-U-shaped fuse element 4 made of an electrically conductive metal, a holder 5 made of a synthetic resin, insulating material, and an igniter unit 6. The terminals 3, 3 each are received in a lower portion of the housing 2. The fuse element is connected to the terminals 3, 3. The holder 5 supports the fuse element 4. The holder 5 is locked in the housing 2 and located at a mid-height portion of the housing 6. The igniter unit 6 is positioned to upwardly oppose to the holder 5. The igniter unit 6 is located inside the pair of terminals 3, 3 in a horizontal direction.

Figure 3:
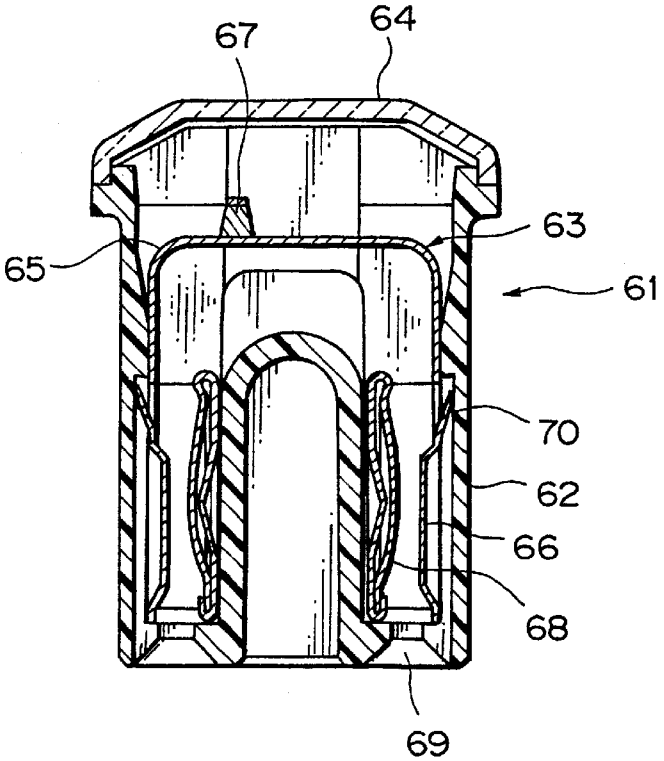
PRIOR ART FIG. 3
FIG. 3 is a longitudinal sectional view showing a conventional large current fuse.
Figure 4:
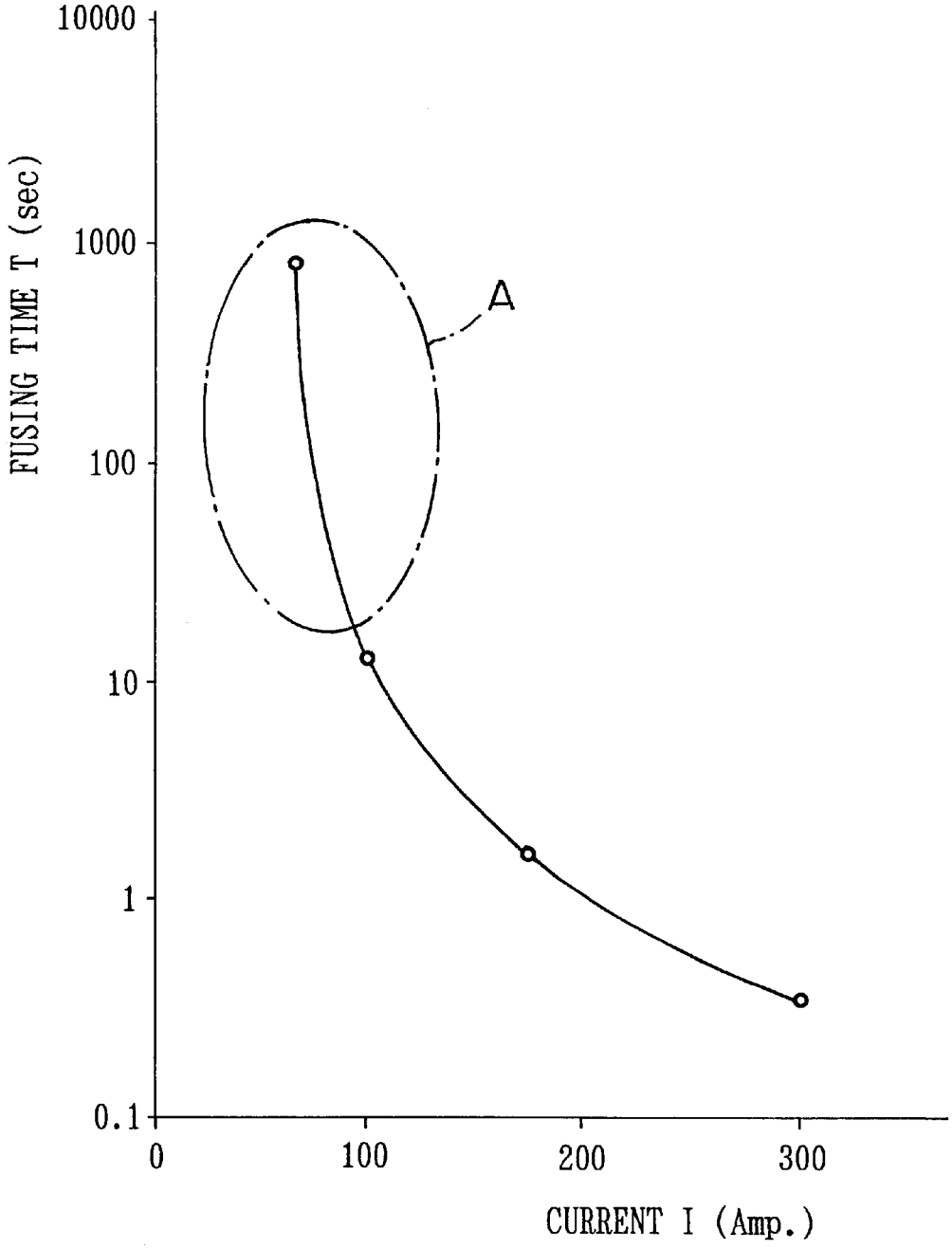
PRIOR ART FIG. 4
FIG. 4 is a graph showing the relationship between current and fusing time of the fuse in FIG. 3.
Figure 6:
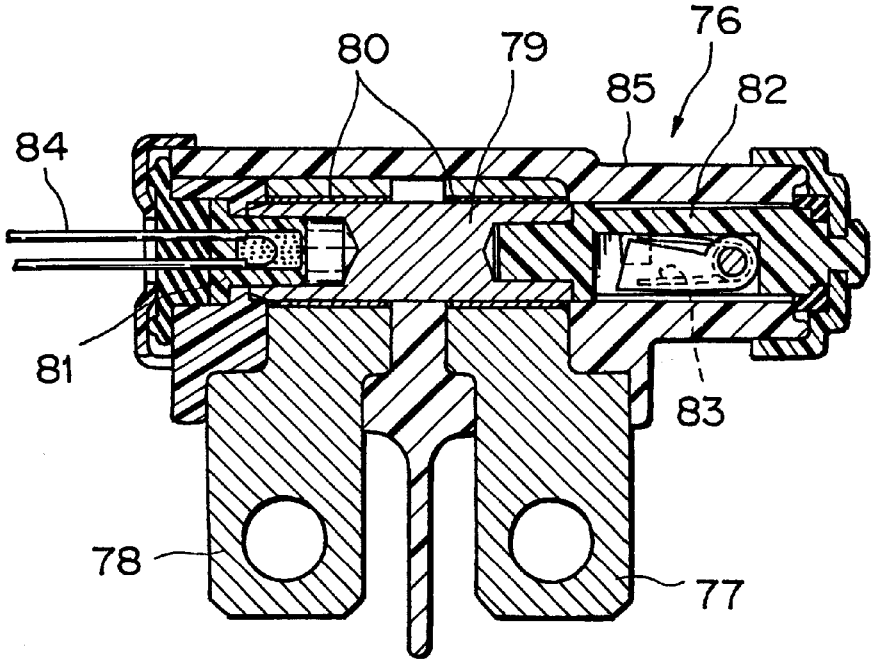
PRIOR ART FIG. 6
FIG. 6 is a longitudinal sectional view showing a conventional power circuit breaker which is in a connection state.
Figure 7:
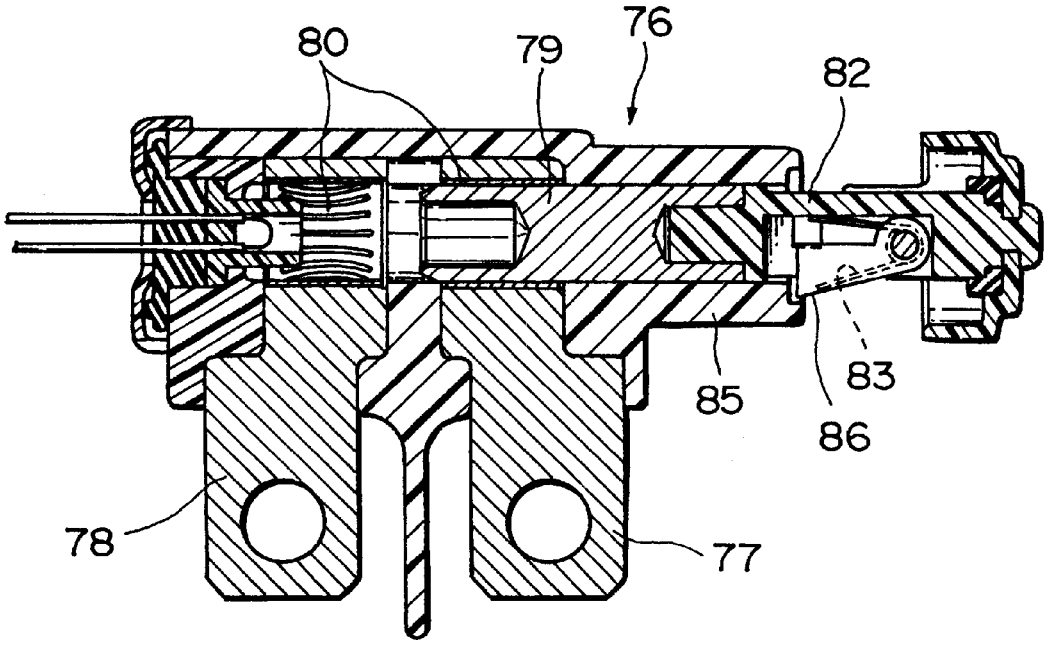
PRIOR ART FIG. 7
FIG. 7 is a longitudinal sectional view showing the conventional breaker which is in a circuit disconnection state.

The housing 2 has, for example, a rectangular shape similar to the housing of the conventional fuse (FIG. 3). The housing 2 has a top opening 7 which is provided with a synthetic resin cover 8. The cover 8 sealingly closes the opening 7 by engagement of a lock hook portion 9 formed on the cover 9 with a locking projection portion 10 formed on the housing 2. In an upper part of the housing 2, there is provided a hollow chamber 11. Under the hollow chamber 11, the holder 5 is located. An upper half of the housing 2 is swelled to be larger than the lower half in width.

The housing 2 has side walls 12, 12 each provided with an inner, resilient locking lance 13 located at a middle height of the housing 2. The lances 13, 13 are symmetrically positioned to lock the holder 5. The locking lance 13 having a root portion 15 extends straight from a tapered part 14 joining the upper half of the hosing 2 to the lower half so as to be inwardly inclined in an upper direction. The lance 13 has an inward locking projection 16 at the free end thereof. The locking projection 16 has an upper inclined guide surface 16*a* and a lower locking face 16*b*. The locking face 16*b* is slightly inclined upward to a horizontal direction. The locking face 16*b* abuts against an inclined shoulder 18 formed on an outer surface 17 of the holder 5.

The housing 2 is unitarily formed with a cylindrical wall 19 therein at a transversely middle part thereof. The cylindrical wall 19 is rectangular or circular in cross-section and has a top opening 20 and a bottom opening 21. From the top opening 20, an upper space 22 of the cylindrical wall 19 receives a central boss 23 of the holder 5 such that there is no clearance between the cylindrical wall 19 and the boss 23. The boss 23 has a shape rectangular or circular in section to meet with the cylindrical wall 19. For easy alignment, the boss 23 and the cylindrical wall 19 each have a round or tapered leading guide surface. The cylindrical wall 19 has an upper half formed with an outer surface 24 slightly inwardly tapered in the upward direction to have a smaller thickness. The inclined outer surface 24 is a guide face for downward entering the interconnection receptacle terminal 3 into a terminal accommodation space 25 located outside the cylindrical wall 19.

The igniter unit 6 is pressed into a mid-height portion of the cylindrical wall 19 to be secured therein under the boss 23 of the holder 5. The cylindrical wall 19 is provided with a horizontal, inward stopper projection 26 which engages with a shoulder 28 formed in a bottom portion 27 of the igniter unit 6 for reliably supporting the igniter unit 6. The igniter unit 6 is downwadly inserted from the upper opening 20 of the cylindrical wall 19 until the igniter unit 6 engages with the stopper projection 26. By the simple assembling step, the igniter unit is mounted to just fit in with the cylindrical wall 19. Between the boss 23 and the igniter unit 6, there is provided a small clearance 22. The igniter unit 6 can be readily removed from the cylindrical wall 19 by pushing upward the bottom 27 of the igniter unit 6 with a little stronger force for replacement of a used one.

The igniter unit 6 consists of a synthetic resin body 29, a gas blasting agent 30 sealingly filled in the body 29, a heating wire 31 positioned in the gas blasting agent 30, and a pair of lead terminals 32 each connected to one end of the heating wire 31. The terminals 32 downwardly extends from the bottom 27 of the body 29. The body 29 is provided with a thin sealing plate 33 formed in the top thereof. The lead terminals 32 are extending in a lower inner space 34 of the cylindrical wall 19. The inner space 34 and the lead terminals 32 compose a recess connector 35. The recess connector 35 engages with an opposing connector (not shown) for supplying an ignition current. The cylindrical wall 19 serves as a cylinder for a piston-like movement of the boss 23 of the holder 6.

Between the cylindrical wall 19 and the side wall 12 of the housing 2, there are provided the terminal accommodation chambers 25. A lower end of the cylindrical wall 19 is joined to a bottom wall 36 of the terminal accommodation chamber 25. The bottom wall 36 is formed with insertion holes 37 for receiving pin terminals of a fuse box (not shown) or etc. The terminal chamber 25 receives the interconnection terminal 3 which is inserted downwadly from the top opening 7, and a resilient locking piece 38 locks the interconnection terminal 3 in the housing 2.

The interconnection terminal 3 has a pair of comparatively smaller resilient strips 40 at an upper side thereof and a comparatively larger, arc-shaped resilient strip 42 at a lower side thereof. The upper resilient strips 40 receive a tab-shaped terminal portion 39 of the fuse element 4. The arc-shaped resilient strip 42 receives a pin terminal 41 of a fuse box (not. shown). The resilient strips 40, 42 each are formed by inwardly turning back a base plate 43 of the interconnection terminal 3. The lower resilient strip 42 is opposed to a vertically flat contact plate portion 59 formed by inwardly raising up the base plate 43.

The resilient strips 40, 42 and the base plate 43 are unitarily S formed from one plate. This unseparated construction decreases components in number and in cost as compared with the conventional fuse element (FIG. 3).

The flat contact plate portion 59 is positioned adjacent to the side wall 12 of the housing 2. The base plate 43 including the flat contact plate portion 59 has a lower end from which the locking piece 38 extends upward in an outward diagonal direction. The locking piece 38 has a free end which abuts against a shoulder 45 formed on an inner wall 44 of the housing 2. The inner wall 44 is formed on an inner surface of the side wall 12 so as to vertically straight extend. The inner wall 44 has a lower end constituting the shoulder 45 inside the housing 2. The interconnection terminal 3 is smoothly inserted along the inclined guide surface 24 the cylindrical wall 19 into the terminal receiving chamber 25 when the holder has not been mounted in the housing 2. During the insertion, the locking piece 38 deflects inwardly to slide downward on the inner wall 44 before it is received in a space under the shoulder 45 to return outward so as to abut against the shoulder 45. The interconnection terminal 3 is readily removed from the housing 2 by inwardly deflecting the locking piece 38 with a tool (not shown) like a flat-type driver and pushing upward a lower end of the interconnection terminal 3.

The fuse element 4, which is connected to the resilient contact strips 40 of the interconnection terminals 3, has a generally inverted-U shape. The fuse element 4 has a base plate 47 including a fuse portion 46, which composes an upper part of the fuse element 4. The fuse element 4 also has a pair of side plates 48 each downwardly extending from one end of the fuse element 4. Each side plate 48 has a lower end portion constituting the tab terminal 39 which is inserted between the pair of the resilient contact strips 40. The fuse portion 46 generally positioned at the center of the base plate 47 is smaller in width than the other part of the base plate 47. Near the fuse portion 46, a tin piece 49 constituting a heat accumulation member and projecting upward is located. The side plate 48 is formed with a locking piece 50 rising up in a diagonal, outward direction. The locking piece 50 abuts against a shoulder 51 formed an inner surface of the side wall 17 of the holder 5, more definitely against a horizontal stopping face of the shoulder 51. The locking piece 50 prevents the fuse element 4 from moving out of the holder 5.

The holder 5 has unitarily a locking wall 53 at each side of the central boss 23 of the holder 5. The locking wall 53 is formed with a through hole 52 for downwardly passing the side plate 48 of the fuse element 4. The locking wall 53 is joined to the boss 23 by way of a connection wall 55 having an inclined inner abutment surface 54. The inner surface 54 abuts against the top end of the cylindrical wall 19, which positions downwadly both the holder 2 including the boss 23 and the tab terminals 39 to rest them thereon.

Adjacent to and outward the through hole 52 of the locking wall 53, the locking shoulder 51 is positioned in the holder 2. Under the shoulder 51, there is provided a channel 56 having a larger sectional area than the through hole 52 for receiving the locking piece 50. The locking wall 53 has an outer wall 17 of which a lower half is embossed outward as compared with the upper half so as to define the shoulder 51. The lower half has an inclined top shoulder 18 adjacent to the upper half The inclined shoulder 18 can stop the locking lance 13 of the housing 2. A stopping face of the shoulder 18 abuts against an engagement face 16*b* of the locking projection 16 of the lance 13, thereby preventing the holder 5 from removing upward out of the housing 2 to be secured thereto. The outer wall 17 of the holder 5 has an outwardly tapered surface 57 at a lower end thereof.

On assembling, the holder 5 is slidingly vertically movable along both the inner walls 44 of the housing 2. The holder 5 is inserted from the top opening 7 of the housing 2 into the space 11 to move downward along the inner walls 44. First, the tapered surface 57 formed at the lower end of the locking wall slidingly abuts against the tapered guide face 16*a* of the locking projection 16 of the locking lance 13, which deflects outward the lance 13. Then, the boss 23 of the holder 5 advances into an inner space of the cylindrical wall 19. Finally, the top of the cylindrical wall 19 abuts against the inclined surface 54 of the holder 5, and at the same time, the locking projection 16 of the lance 18 engages with the shoulder 18 of the holder 2. Thus, the holder 2 is assembled in the housing 2 with ease.

The fuse element 4 has been preliminarily mounted in the holder 5. The fuse element 4 can be assembled in the holder 2 in a single step so that the tab terminals 39 of the fuse element 4 are inserted into the through holes 52 of the holder 5 until the side plates 48 of the fuse element 4 are received in the holder 2. During the insertion, the locking piece 50 is deflecting inward in the through hole 52. When the base plate of the fuse element 4 abuts against a top surface of the connection wall 55 of the holder 5, the locking piece returns outward to engage with the shoulder 51.

Next, operation of the power circuit breaker shown in FIG. 1 will be discussed hereinafter.

In the state shown in FIG. 1, when an overcurrent. is applied to the pin terminals 41, a sensor provided in a fuse box (not shown) senses the overcurrent. The sensor is enough sensitive to detect even an overcurrent only a little larger than a threshold value. According to the detection of the overcurrent, a current is applied to the lead terminals 32 of the igniter unit 6. This heats up the heating wire so that the gas agent 30 is ignited to generate a blasting gas instantaneously. As illustrated in FIG. 2, the blasting gas breaks the seal plate 33, so that the gas pressure pushes the boss 23. As a result, the holder 5 is instantaneously moved upward into the upper hollow 11. The fuse element 4 moves upward together with the holder 5, so that the tab terminals 39 are released from the interconnection terminals 3, thereby cutting off the associated power circuit.

A pushing force P exerted on the holder 5 by the blasting gas of he igniter unit 6 is determined to be larger than the sum of a stopping force P1 of the lance 13 for the holder 5 and the friction force P2 of the interconnection terminals 3 to the fuse element 4. That is, $P>P1+P2$.

Now, advantages of the embodiment will be discussed. The igniter unit 6 is mounted in the cylindrical wall 19, and the central boss 23 of the holder 5 is inserted to engage with the cylindrical wall 19 with no clearance therebetween. Hence, the gas pressure generated by the igniter unit 6 effectively pushes out the boss 23 from the cylindrical wall 19. The striking force P is larger than the sum of the stopping force P1 and the friction force P2, which positively releases the holder 5 from the lance 13 of the housing 2. The arrangement of the igniter unit 6 and the boss 23 in the cylindrical wall 19 allows a smaller amount of gas blasting agent 30 (FIG. 1), so that the igniter unit 6 may be compact.

The released holder 5, as shown in FIG. 2, rests on the tops of the lances 13 within the upper hollow 11. That is, the tapered face 16*a* of the locking projection 16 of the lance 13 abuts against the lower end tapered face 57 of the outer wall 17. This prevents the holder 5 from moving in the reverse direction, so that the tab terminals 39 of the fuse element 4 may not contact again the interconnection terminals 3. The lance 13 allows the locking of the holder 5 during an on-state of the circuit as shown in FIG. 1. The lance 13 also can rest the holder 5 to keep an off-state of the circuit as shown in FIG. 2. This enables a simplified construction and reduces parts in number for the power circuit breaker.

The holder 5 is easily returned to the locked position by downwardly moving the holder 5 against the supporting force of the lance 13 after the igniter unit 6 is replaced by a new one. The cover 8 of the housing 2 is readily removed by unlocking the lock hook 9 from the locking projection 10.

In the power circuit breaker shown in FIG. 1, the ignition of the igniter unit 6 disconnects the tab terminals 39 of the fuse element 4 from the interconnection terminals 3 as shown in FIG. 2, even when no overcurrent is applied in the associated circuit. For example, the ignition is carried out on an abnormal state of the vehicle such as collision or an unintentional heat generation in the vehicle. The ignition is also carried out before fusing of the fuse element, when the current in the associated circuit is only a little larger than a reference value. When a sensed overcurrent is significantly larger than a reference value, the fuse element may be fused without the ignition of the igniter unit 6. This requires only replacement of the fuse element 4 for reuse of the power circuit breaker.

The power circuit breaker 1 may be used for various types of vehicles or machines only with modifying the fuse element 4. That is, the other parts including the holder 5, the interconnection terminal 3, the housing 2, and the igniter unit 6 are commonly used for different applications. This advantage is obtained by providing the fuse element 4 and the interconnection terminals 3 which are separately constructed unlike the conventional large current fuse shown in FIG. 3.

The power circuit breaker 1 of the embodiment is only a little larger in size than the conventional large current fuse. The power circuit breaker 1 has a simplified configuration consisting of the fuse element 4 positioned above the interconnection terminals 3, the holder 5 retaining the fuse element 4, and the igniter unit 6 mounted under the holder 5. Thus, the power circuit breaker 1, which consists of parts reduced in number and cost, is more compact than the conventional breaker described in the prior art.

What is claimed is:

1. A power circuit breaker comprising:

a main housing having side walls, an igniter unit disposed in a cylindrical wall formed in said main housing, a holder disposed in the cylindrical wall so as to be in contact with said igniter unit, a boss of said holder engaging with the cylindrical wall, a fuse element held by said holder, and a pair of interconnection terminals disposed in said main housing, wherein each end of said fuse element is electrically connected to one of the interconnection terminals.

2. The breaker recited in claim 1, wherein said holder is locked by a locking lance formed in said main housing when each end of said fuse element has engaged with one of the interconnection terminals.

3. The breaker recited in claim 2, wherein an activating pressure force generated by said igniter unit is larger than the sum of the stopping force of said locking lance and the friction force of the interconnection terminals to said fuse element.

4. The breaker recited in claim 2, wherein said holder rests on said locking lance when said fuse element has been released from the interconnection terminals after activation of said igniter unit.

5. The breaker recited in claim 1, wherein said fuse element is engaged with and stopped by an insertion hole of said holder.

6. The breaker recited in claim 1, wherein said igniter unit is pressed into and mounted in said cylindrical wall.

7. The breaker recited in claim 1, wherein the interconnection terminals each are locked in said main housing with a locking piece.

8. The breaker recited in claim 1, wherein the interconnection terminals each are a receptacle type terminal having two resilient contact strip portions one of which is connected to one end of said fuse element and the other of which is connected to an opposing terminal of a power circuit.

9. The breaker recited in claim 1, wherein the fuse element has a fusing portion reduced in sectional area.

10. The breaker recited in claim 1, wherein the fuse element has a thermal accumulation piece.

* * * * *